US005313439A

United States Patent [19]

Albeck

[11] Patent Number: 5,313,439

[45] Date of Patent: May 17, 1994

[54] TIMER DEVICE FOR MEDICATIONS

[76] Inventor: Dan Albeck, 10 David Elazar Street, 51905 Givat Shmuel, Israel

[21] Appl. No.: 914,343

[22] Filed: Jul. 17, 1992

[51] Int. Cl.[5] ..... G04B 47/00

[52] U.S. Cl. ..... 368/10; 368/109; 368/89; 116/308; 206/534

[58] Field of Search ..... 368/16, 109, 107, 89; 206/534; 116/308; 221/3

[56] References Cited

U.S. PATENT DOCUMENTS 4,223,801 9/1980 Carlson .
4,258,354 3/1981 Carmon et al. .
4,275,384 6/1981 Hicks et al. .
4,361,408 11/1982 Wirtschafter .
4,367,955 1/1983 Ballew .
4,382,688 5/1983 Machamer .
4,419,016 12/1983 Zoltan .
4,483,626 11/1984 Noble .
4,504,153 3/1985 Schollmeyer et al. .
4,526,474 7/1985 Simon .
4,611,924 9/1986 Stasin .
4,660,991 4/1987 Simon ..... 368/10
5,072,430 12/1991 Eckernas et al. .

*Primary Examiner*—Bernard Roskoski
*Attorney, Agent, or Firm*—Mark M. Friedman

[57] ABSTRACT

A simple and inexpensive, preferably disposable, medication package which is capable of reminding a user when it is time to take the medication. In one embodiment the package is an ordinary medicine bottle with the cap modified so as to include a timer, a battery, a buzzer or display light and a means for closing a circuit. When the cap is closed, the circuit is automatically closed through contact with a conducting material on the upper edge of the bottle. In another embodiment, the container is of the foil pack variety. A receptacle is provided. When the foil pack is inserted into the receptacle, the circuit is closed energizing the timer and related mechanisms. In a third embodiment, the container is again of the foil pack variety where the foil has a suitable resistivity. No receptacle is included. Rather, the timer mechanism is activated through the sensing of a resistance change as the foil is ruptures whenever each of the pills is removed.

21 Claims, 4 Drawing Sheets

TIMER DEVICE FOR MEDICATIONS

FIELD AND BACKGROUND OF THE INVENTION

The present invention relates to timer mechanisms for use in conjunction with the taking of medications and, more particularly, to automatic devices which facilitate the taking of medications at the proper time intervals.

Most medications are most effective when received by the body over a period of time. Preferably, such medications should be administered as tiny doses administered with great frequency. Ideally, the administration should be continuous. This is indeed accomplished with intravenous medication which is common in hospitals. Recently there have developments in the area of skin patches which are worn by the user and which continuously release medication through the skin over a period of hours or days. Related developments have been in the area of time-release capsules which are designed to release the medication into the stomach over a period of time following swallowing.

For most purposes, however, it is of ten adequate to approximate continuous administration of medications by the periodic swallowing of pills, whether time-released or not. Thus, most medication comes with instructions to swallow one pill every six hours, or two pills every three hours, etc.

The difficulty with such periodic administration of medications is that the patient, or the one administering the medication to the patient, often errs in the administration. It is quite common for patients to forget to take a pill or to forget that they recently took a pill and take an additional pill. Both situations mitigate against the effective administration of the medication and could, in some instances, have very harmful results. The problem is aggravated by the fact that, on the average, the population taking medication is older and sicker than the population at large. This makes it even more likely that deviations will occur from the prescribed medication administration regiment.

Because the problem is widely recognized, a large number of solutions have been offered. The solutions to date each suffer from one or more of several disadvantages. In many cases a device is proposed includes compartments for the pills and which features one or more timer mechanisms. These devices are usually bulky and in many cases require the transfer of the pills from their original container to the device. More importantly, these devices are complicated which makes them expensive and renders them difficult to set up and use, especially by elderly people.

Devices have been developed which can be attached to or incorporated into conventional medicine bottles. Examples of these include the devices disclosed in U.S. Pat. Nos. 4,361,408, 4,367,955 and 4,419,016. These devices continue to suffer from the disadvantage of being relatively cumbersome and expensive.

There is a widely recognized need for, and it would be highly advantageous to have, an inexpensive and highly simple device which will make it alert a patient when it is time to take a medication. It would be further highly advantageous if this device could part of the original packaging of the medicine and, like the packaging, be disposable.

SUMMARY OF THE INVENTION

According to one embodiment of the present invention there is provided A medication packaging system capable of reminding a user when it is time to take the medication, comprising: (a) a container for holding the medication, the container having electrically conducting material on a portion of its surface; and (b) a cap for closing off the container, the cap including: (A) a timer means; (B) an output means for outputting information from the timer means; (C) a power source capable of powering the timer means and the output means; and (D) a circuit closing means for electrically connecting said power source and said timer and output means whenever said cap is closed on said container so that said circuit closing means makes electrical contact with said electrically conducting material of said container.

According to further preferred features of the first embodiment of the invention described below, the conducting material is located on the edge of the opening of the container, and is preferably the remaining portion of the aluminum which was previously part of the tamper-proof seal.

According to a second embodiment of the present invention there is provided a pill packaging system capable of reminding a user when it is time to take the medication, comprising: (a) a foil pack container for holding the pills, the container having electrically conducting material as its bottom surface; and (b) a receptacle for receiving the foil pack container, the receptacle including: (A) a timer means; (B) an output means for outputting information from the timer means; (C) a power source capable of powering the timer means and the output means; and (D) a circuit closing means for electrically connecting said power source and said timer and output means whenever said foil pack container is in said receptacle so that said circuit closing means makes electrical contact with said electrically conducting material on the bottom of said foil pack container.

According to a third embodiment of the present invention there is provided a pill packaging system capable of reminding a user when it is time to take the medication, comprising: a foil pack container for holding the pills, the container having a material of suitable electrical conductivity as its bottom surface, the foil pack container further including: (A) a timer means; (B) an output means for outputting information from the timer means; and (C) a power source electrically connected to, and powering, the timer means and the output means, the electrical connection taking place through the conducting surface on the bottom of the foil pack container, such that the resistance of the conducting surface increases perceptibly as the electrically conducting material is ruptured to remove the pills.

The present invention successfully addresses the shortcomings of the presently known configurations by providing a medication package which is preprogrammed to reliably reminds the user when it is time to take the medication and which is simple and inexpensive to such an extent that it may be part of standard disposable medication packages.

BRIEF DESCRIPTION OF THE DRAWINGS

The invention is herein described, by way of example only, with reference to the accompanying drawings, wherein.

DESCRIPTION OF THE PREFERRED EMBODIMENTS

Figure 1A:
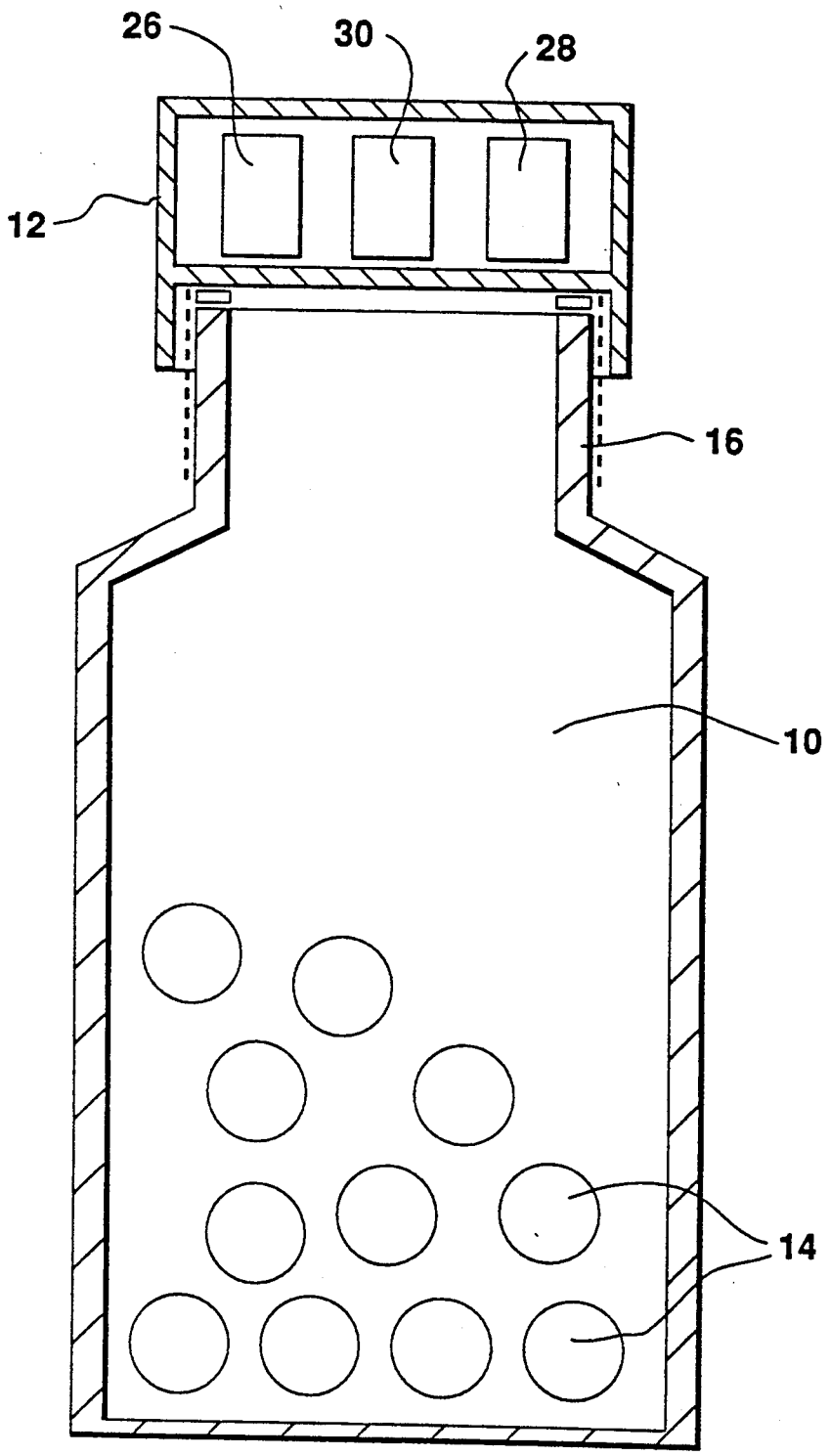
FIG. 1*a* is a side view of a first embodiment according to the present invention based on a medication bottle.
Figure 1B:
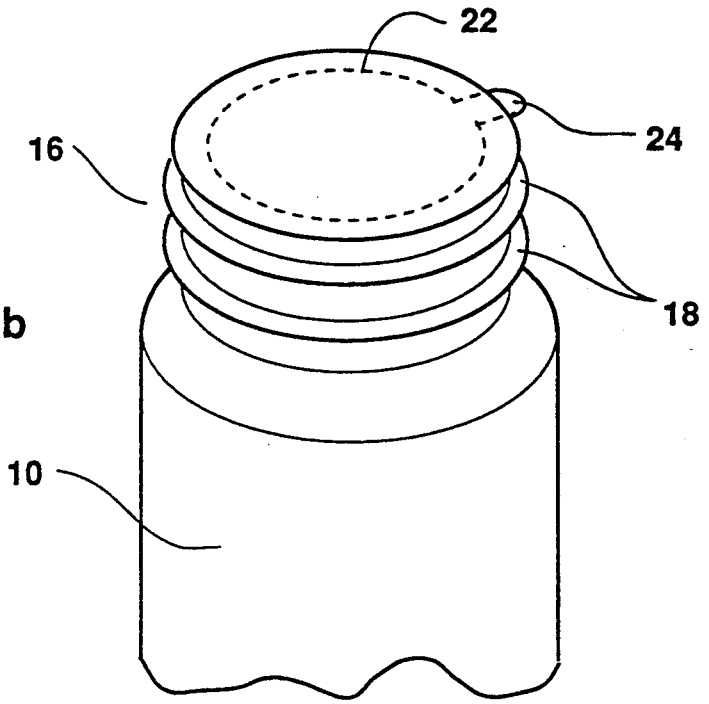
FIG. 1*b* shows the top portion of the container with its top rim covered with an electrically conducting material.

The present invention is of a medicine packaging which can be used to alert the user when it is time to take the medication.

The principles and operation of devices according to the present invention may be better understood with reference to the drawings and the accompanying description.

Referring now to the drawing, FIGS. 1*a*, 1*b*, 1*c* and 1*d* illustrate several aspects of a first embodiment according to the present invention. Depicted in FIG. 1 is a medication bottle made up of a container 10 and a cap 12. Container 10 may contain pills 14 or it may contain medication in liquid form (not shown).

The top portion of container 10 is typically a neck 16. Neck 16 may feature threads 18 (FIG. 1*b*) capable of engaging cap 12. Alternatively, neck 18 may be engageable to cap 12 through a snap-on connection (not shown).

Container 10 may be any of the suitable conventional containers being used for medicines. Container 10 also includes a tamper-proof seal 20 which is ordinarily made of metallic foil, typically aluminum foil. When cap 12 is removed by the user for the first time, seal 20 is broken, usually by pushing downward in the central portion of seal 20.

As will be discussed below, it is important for the operation of a device according to the present invention that at least some of seal 20 remain around the periphery of the top edge of neck 16. To that end it is preferable to include the beginnings of perforations, or weak points 22 on the surf ace of seal 20 at points generally just inside the inside periphery of the rim of neck 16. In this manner, when seal 20 is pushed down, weak points 22 will readily give way and prevent the removal of those portion of seal 20 located directly on the rim of neck 16.

It may, in addition, be preferable to further use a seal 20 which includes a short tongue 24 which overhangs the rim of neck 16. Weak points 22 may be extended to run to tongue 24. In this way the user is encouraged to break seal 20 by grabbing tongue 24 and pulling it so as to remove that portion of seal 20 within the area defined by the weak points 22, thus leaving virtually intact that portion of seal 20 which immediately covers the rim of neck 16.

Another means of accomplishing this, and which may be used as an addition or as an alternative to the techniques described above, calls for use of sufficiently strong adhesive to bind seal and neck 16 together so that the portion of seal 20 in contact with neck 16 will not easily be detached.

Cap 12, which may be of the screw-on or snap-on type, appears from the outside to be a conventional medicine bottle cap, except that it may be slightly taller than conventional caps. Cap 12 has a number of features which distinguish it from conventional caps and which make it possible to alert the user when it is time to take the medication.

First, cap 12 includes timer means 26 which includes a clock and preferably includes a memory device, such an integrated circuit which contains the information needed to operate the system. This information includes first and foremost the desired time interval. It may be desirable to produce a variety of caps, each with a timer means which has been preset by the manufacturer for a particular standard time interval. For example, useful standard time intervals might be 1 hours, 2 hours, 3 hours, 4 hours, 6 hours, 8 hours, 12 hours and 24 hours. It may be desirable to color-code the caps where each color corresponds to a particular standard time interval. In addition, or alternatively, it may be desirable to imprint on each cap the time interval to which it corresponds.

The information may also include information as to how the user is to be alerted. For example, to conserve energy, it may be desirable to have the output device issue a series of indications for a period of 30 seconds. If the user has not responded by opening the bottle within 5 minutes, a second series of indications is initiated for a second period of 30 seconds, and so on. This sequence is illustrative only. The possible sequences are almost limitless.

Cap 12 also includes one or more output means 28 for outputting information from the timer means to the user. Any convenient mechanism may be used. Preferably, output means 28 is a small audio indicator generator, such as a speaker or buzzer capable of making an audible sound, such as a series of beeps. The audio indicator generator may include a piezoelectric mechanism. This is especially useful for users who may have poor eyesight. Output means 28 may alternatively, or in addition, be a visual indicator generator, such as a small light, such as a light emitting diode (LED). This is especially useful for users who may be hard of hearing.

Cap 12 further includes a power source 30 capable of powering timer means 26 and output means 28. Power source 30 may be any suitable mechanism. Preferably, power source 30 is a miniature battery, most preferably a battery similar to that used in electronic wrist watches.

Figure 1C:
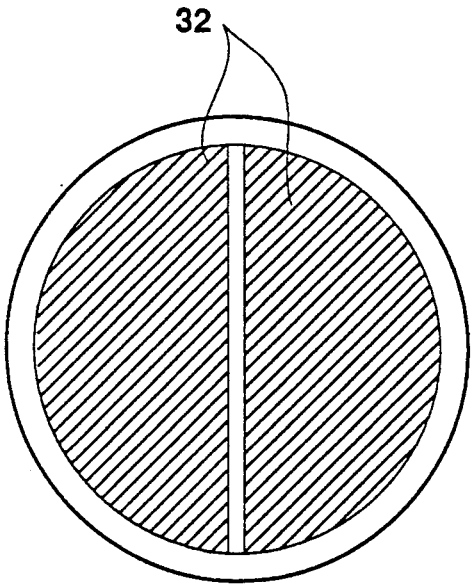
FIG. 1*c* is a bottom view of the cap showing the two electrical contacts of the circuit closing means.
Figure 1D:
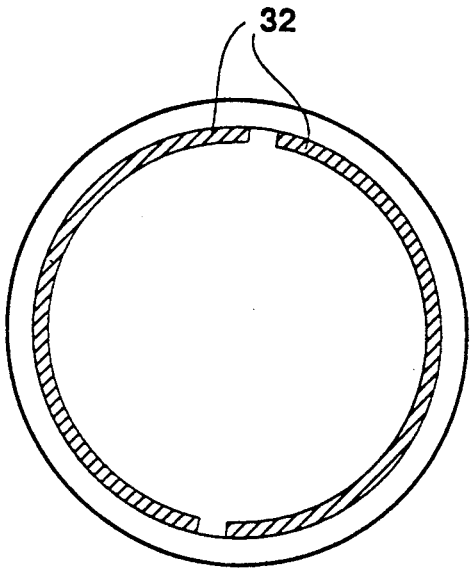
FIG. 1*d* is as shown in FIG. 1*c* but with contacts having a different configuration.

Cap 12 further includes a circuit closing means (which will referred to below as 'switch' but which is to be distinguished from conventional electromechanical switches). 'Switch' 32 is capable of electrically connecting power source 30 to timer means 26 and to output means 28. 'Switch' 32 can take on a variety of configuration. Two illustrative configurations are depicted in FIGS. 1*c* and 1*d*. Both FIG. 1*c* and 1*d* show cap 12 removed from container 10 as cap 12 would appear when viewed from the bottom. In each case 'switch' 32 is made up of a pair of contacts, each contact made of an electrically conducting material.

In FIG. 1*c* the contacts are each nearly semicircular in shape while in FIG. 1*d* the contacts are each of an annular shape located near the inner periphery of cap 12 in a location approximately corresponding to the upper rim of neck 16 of container 10 when cap 12 is closed on container 12.

The operation of a device according to the first embodiment of the present invention is straightforward. The manufacturer or the pharmacist would install cap 12, which has been preprogrammed to operate with the proper time interval, over a medicine container 10. To prevent the timer from being activated during shipment and storage, a non-conducting material, such as a small piece of plastic film (not shown) would be inserted between seal 20 and 'switch' 32 just prior to, or concurrent with, the installation of cap 12 onto container 10. Alternatively, cap 12 may be initially attached to container via a spacer (not shown) which keeps cap 12 a certain distance from container 10 and thus prevents the circuit from being closed. To open the package, the spacer is broken. Subsequent closing of cap 12 results in the closing of the circuit and activation of the timing system. Preferably, the circuit is closed during shipment and storage prior to the initial opening but the timer is preprogrammed not to activate the buzzer until after the second time that cap 12 is mounted onto container (the first time being at the time of initial packaging by the manufacturer).

After the user has purchased the medicine the user will proceed to remove cap 12. The user will then rupture tamper-proof seal 20 as described above to gain access to the contents of container 12. The user will remove the desired medicine and, presumably, ingest same. Just before or just after ingestion of the medicine the user will close container 10 by either screwing-on or snapping-on cap 12. When this is done the portions of seal 20 which remain on the top edge of the rim of neck 16 of container 10 will make contact with 'switch' 32 located in cap 12 and close the 'switch' 32.

At this point timer means 26 will be energized by power source 30. Timer means 26 will keep track of the time elapsed since cap 12 was closed. When the pre-programmed interval expires, output means 28 will be activated to alert the user that it is time to take the next dose of medicine. When the user opens cap 12, the circuit is broken, power is cut off from timer means 26 and output means 28. When cap 12 is once again closed, energy supply is resumed, timer means 26 resets its clock and begins to count a new interval. The cycle is then repeated until all the medicine has been consumed at which point the entire package, including the cap, may be discarded.

Figure 2A:
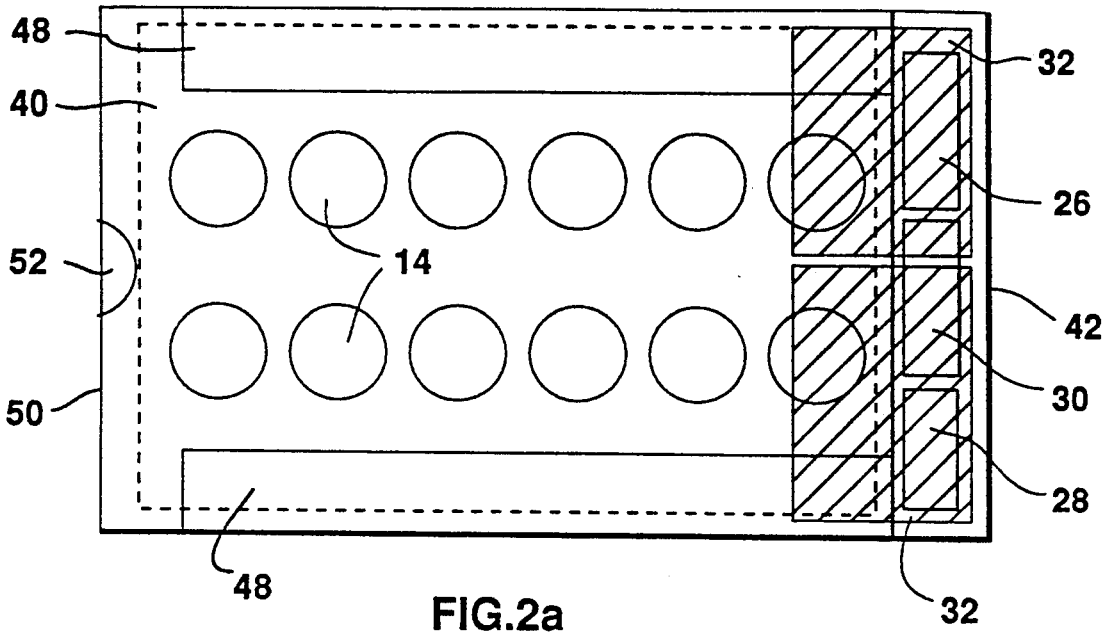
FIG. 2*a* is a top view of a second embodiment according to the present invention based on a foil pack container.
Figure 2B:
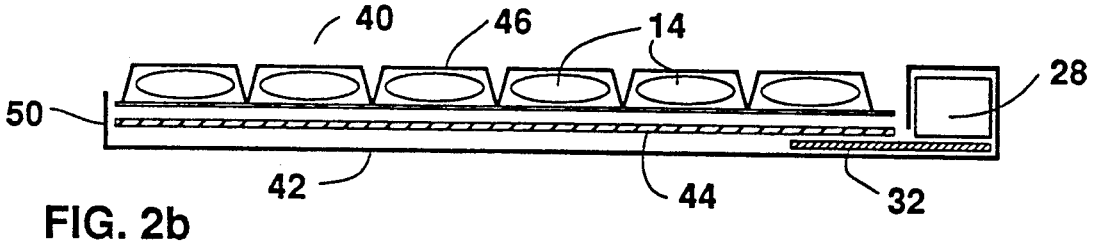
FIG. 2*b* is a side view of the embodiment of FIG. 2.

FIGS. 2*a* and 2*b* show two views of a second embodiment according to the present invention. Depicted in FIGS. 2*a* and 2*b* is a medicine sheet, also known as bubble cap, or foil pack container. For consistency, in what follows, we refer to this type of packaging as 'foil pack.' The foil pack container is quite popular in the packaging of medicine and related materials, such as throat lozenges. Beside the foil pack 40, FIGS. 2*a* and 2*b* also depict a receptacle 42 into which foil pack 40 easily fits.

A typical foil pack 40, such as the one illustrated in FIGS. 2*a* and 2*b* is made up of two portions which are adhered together with the pills 14 trapped between them. Located below pills 14 is a substantially planar layer of thin foil 44. Typically, foil 44 is made of a metallic, electrically conducting material, most commonly aluminum. Foil 44 may be made up of a conducting portion and a nonconducting portion, with the conducting portion extending from one end of foil pack 40 to a distance sufficient to establish suitable electrical contact when foil pack 40 is inserted into receptacle 42 with the rest of foil 44 being of a non-conducting material. Located above pills 14 is a cover 46, typically made of clear plastic by a vacuum formed technique. Except in those areas where cover 46 is directly over pill 14, cover 46 is attached, by some convenient adhesive or other technique, to the top surface of foil 44. Foil pack 40 for use according to the second embodiment of the present invention may a standard foil pack as currently being used, without the need for any modifications or alterations.

Receptacle 42 into which foil pack 40 fits, can be made of any convenient material, preferably it is made by vacuum forming of the same plastic material from which cover 46 is made.

As described above in the context of the cap of the first embodiment, receptacle 42 includes timer means 26, output means 28, and power source 30. Preferably, these components are sealed at one end of receptacle as shown in FIG. 2*b*.

Receptacle 42 also includes 'switch' 32 which is made up of two electrically conducting portions, preferably made of aluminum foil located at the upward-facing surface of receptacle 42 as shown in FIG. 2*a* and 2*b*. 'Switch' 32 is situated so that when foil pack 40 is inserted completely into receptacle 42 foil 44 of foil pack 40 provides the contact which closes 'switch' 32 and activates the system as described above in the context of the first embodiment.

Receptacle 42 is sized and shaped so as to easily and securely receive foil pack 40 after each use. Preferably, receptacle 42 includes guiding tracks 48 on both sides to guide foil pack 40 into the proper place. Preferably, also, the end of receptacle 42 nearest 'switch' 32 is shaped so as to guide foil 44 of foil pack 40 into sure contact with 'switch' 32 without pealing or otherwise damaging 'switch' 32. This may be accomplished, for example, by recessing 'switch' 32 slightly into receptacle 42 so that top surface of 'switch' 32 is flush with the floor of receptacle 42. Additionally, or alternatively, it may be desirable to taper guiding tracks 48 in such a way (not shown) that they guide foil pack 40 to a position just above 'switch' 32 and then force foil pack 40 directly onto 'switch' 32 forming a good electrical contact.

The end of receptacle 42 which is furthest from 'switch' 32 preferably features an upturned edge 50, whose purpose is to encourage the user to push foil pack 40 forward into receptacle 42 to the maximum extent possible, so as to ensure that 'switch' 32 is closed. It may be desirable to form upturned edge in two sections with a finger slot 52 between them to facilitate removal of foil pack 40 from receptacle 42.

The operation of a device according to the second embodiment of the present invention is straightforward. The manufacturer would typically include receptacle 42 along with two or three conventional foil packs 40 in a paperboard box (not shown). Timer means 26 would already be pre-programmed to operate with the proper time interval.

After the user has purchased the medicine the user will proceed to open the paperboard box. The user would then rupture foil 44 immediately below one of pills 14, remove and, presumably, ingest same. Just before or just after ingestion of the medicine the user will place foil pack 40 in receptacle 42. When this is done the foil 44 of foil pack 40 will contact 'switch' 32 in receptacle 42 and close 'switch' 32.

At this point timer means 26 will be energized by power source 30. Timer means 26 will keep track of the time elapsed since foil pack 40 was inserted into receptacle 42. When the preprogrammed interval expires, output means 28 will be activated to alert the user that it is time to take the next dose of medicine. When the user removes foil pack 40 from receptacle 42, the circuit is broken, power is cut off from timer means 26 and output means 28. When foil pack 40 is once again inserted into receptacle 42, energy supply is resumed, timer means 26 resets its clock and begins to count a new interval. The cycle is then repeated until all the medicine originally contained in foil pack 40 has been consumed at which point the empty foil pack 40 is discarded and a fresh foil pack 40 is inserted into receptacle 42. Once the two or three foil packs 40 have been emptied of their medicine, receptacle 42 as well as the last empty foil pack 40 may be discarded.

Figure 3A:
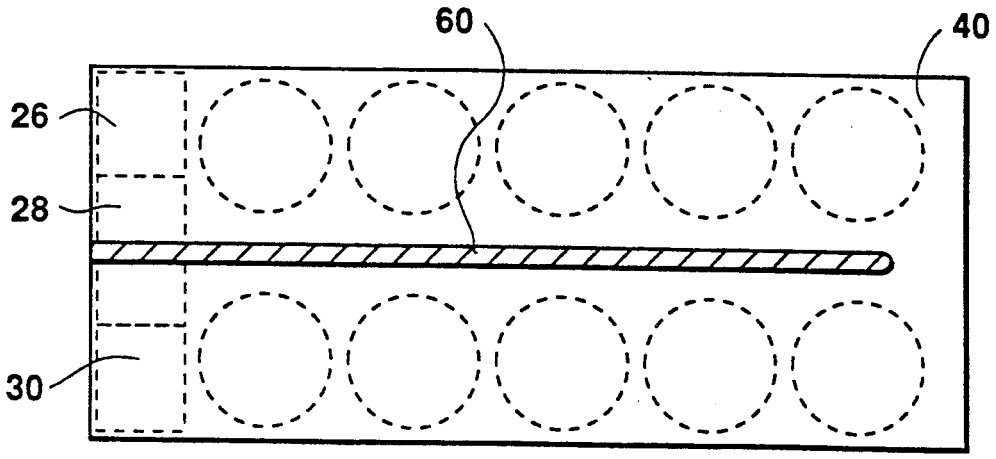
FIG. 3*a* is one version of a third embodiment according to the present invention based on a foil pack container with special foil.
Figure 3B:
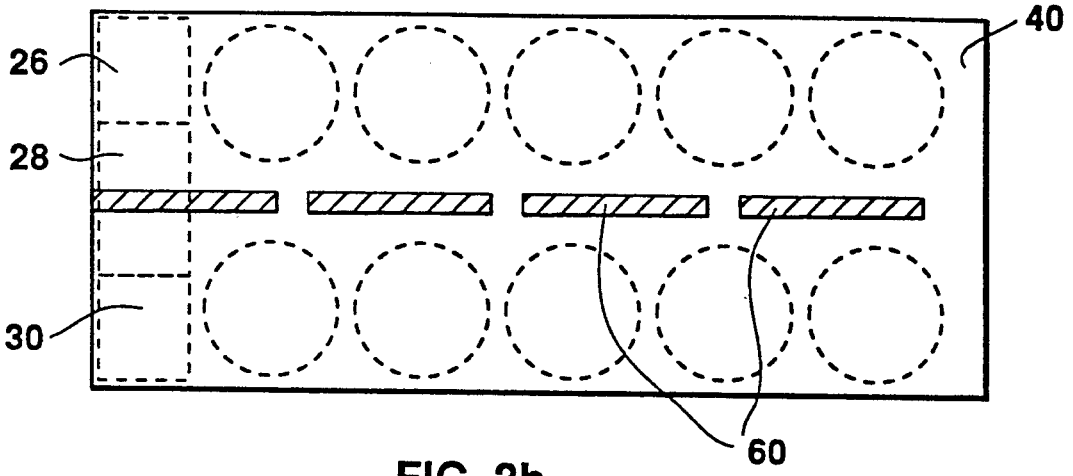
FIG. 3*b* is another version of the third embodiment.
Figure 4A:
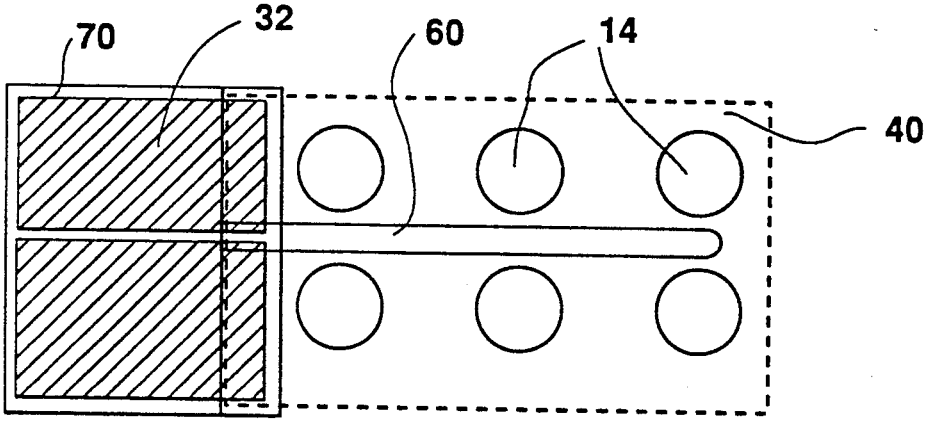
FIG. 4*a* is a side view of yet another version of a third embodiment according to the present invention based on a foil pack container with special foil.
Figure 4B:
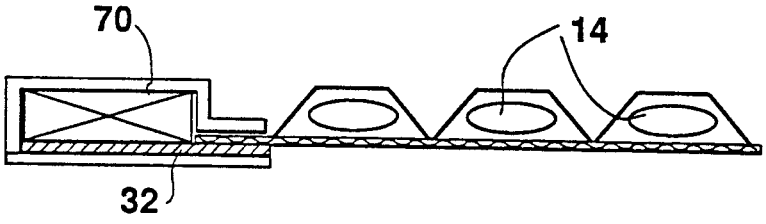
FIG. 4*b* is a bottom view of the embodiment of FIG. 4*a*.

FIGS. 3*a* and 3*b* show two versions of a first version of a third embodiment according to the present invention. Depicted in FIGS. 3*a* and 3*b* are systems which resemble the foil pack of the second embodiment. Noticeably missing is the receptacle. The systems in FIGS. 3*a* and 3*b* differ from the foil pack of the second embodiment in several important respects.

First, it is to be noted that timer means 26, output means 28 and power source 30 are now located on foil pack 40 itself rather than on the receptacle, which plays no role in this version of the third embodiment.

The foil used in the third embodiment is composed of at least one layer made up of a partially conducting material having a conductivity which is much lower than the conductivity of aluminum or similar metals, typically in the range of from about 10 to about 100 (ohm cm)$^{-1}$. Such materials may include, indium tin oxide (ITO), polyppyrrole (doped with $LiClO_4$), polythiophene, polyaniline, polyacetylene, and the like. These materials may take the form of lacquers and may conveniently be applied in the liquid state. Other suitable materials may include $PbO_2$, SnO, ZnO, and the like.

Finally, the foil is not continuous but is rather interrupted by a long divider (FIG. 3*a*) or a series of shorter divider segments (FIG. 3*b*) made up of insulating material 60.

Electrical contact between power source 30 and timer means 26 and output means 28 is through the partially conducting material of foil pack 40. Before the foil is ruptured to remove a pill, the resistivity of the system is at a certain value. Each time the foil is ruptured to remove a pill, the resistivity of the system increases by a certain amount. Timer means 26 is designed to detect this increase and to trigger its timing function upon the occurrence of this event. The operation of a device according to the third embodiment is otherwise similar to that of a device according to the second embodiment described above. Preferably, the timing system will be activated by the rupturing of the first piece of foil, i.e., when the first pill or tablet is removed.

In a second version of the third embodiment, power source 30 timer means 26 and output means 28 are stored in a separate timer housing 70, which is similar in function to receptacle 42 of the second embodiment described above and shown in FIGS. 2*a* and 2*b*. Unlike receptacle 42 of the second embodiment, timer housing 70 need not include a portion intended to contain foil pack 40 and merely serves to house power source 30 timer means 26 and output means 28. Timer housing 70 preferably does not extend to the area below pills 14 so as to allow the user, if desired, to rupture the foil and remove pills 14 without detaching foil pack 40 from timer housing 70.

While the invention has been described with respect to one preferred embodiment, it will be appreciated that many variations, modifications and other applications of the invention may be made.

What is claimed is:

1. A medication packaging system capable of reminding a user when it is time to take the medication, comprising:

(a) a container for holding the medication, said container having electrically conducting material on a portion of its surface; and (b) a cap for closing of f said container, said cap including:

(A) a timer means;

(B) an output means for outputting information from said timer means;

(C) a power source capable of powering said timer means and said output means; and (D) a circuit closing means for electrically connecting said power source and said timer and output means whenever said cap is closed on said container so that said circuit closing means makes electrical contact with said electrically conducting material of said container.

2. A system as in claim 1 wherein said conducting material is located on the edge of the opening of said container.

3. A system as in claim 2 wherein said conducting material is aluminum which was previously part of the tamper-proof seal.

4. A system as in claim 1 wherein said timer means includes memory means for storing information on the timing interval.

5. A system as in claim 1 wherein said timer means is an integrated circuit.

6. A system as in claim 1 wherein said output means includes an audio indicator generator.

7. A system as in claim 1 wherein said output means includes a visual indicator generator.

8. A system as in claim 1 wherein said power source is a battery.

9. A system as in claim 1 wherein said battery is a watch battery.

10. A system as in claim 1 wherein said circuit closing means includes two electrical conductor segments arrayed on said cap so as to engage said electrically conducting material on said container when said cap is closed.

11. A pill packaging system capable of reminding a user when it is time to take the medication, comprising:

(a) a foil pack container for holding the pills, said container having electrically conducting material as its bottom surface; and (b) a receptacle for receiving said foil pack container, said receptacle including:

(A) a timer means;

(B) an output means for outputting information from said timer means;

(C) a power source capable of powering said timer means and said output means; and (D) a circuit closing means for electrically connecting said power source and said timer and output means whenever said foil pack container is in said receptacle so that said circuit closing means makes electrical contact with said electrically conducting material on the bottom of said foil pack container.

12. A system as in claim 11 wherein said timer means includes memory means for storing information on the timing interval.

13. A system as in claim 11 wherein said timer means is an integrated circuit.

14. A system as in claim 11 wherein said output means includes an audio indicator generator.

15. A system as in claim 11 wherein said output means includes a visual indicator generator.

16. A system as in claim 11 wherein said power source is a battery.

17. A system as in claim 11 wherein said battery is a watch battery.

18. A system as in claim 11 wherein said circuit closing means includes two electrical conductor segments arrayed on said receptacle so as to engage said electrically conducting material on the bottom of said foil pack container when said foil pack container is inserted in said receptacle.

19. A pill packaging system capable of reminding a user when it is time to take the medication, comprising:

(a) a foil pack container for holding the pills, said container having a material of suitable electrical conductivity as its bottom surface; and (b) a housing for attachment to said foil pack container, said housing including:

(A) a timer means;

(B) an output means for outputting information from said timer means;

(C) a power source capable of powering said timer means and said output means; and (D) a circuit closing means for electrically connecting said power source and said timer and output means whenever said foil pack container is attached to said housing, said electrical connection taking place through said partially conducting surface on the bottom of said foil pack container such that the resistance of said partially conducting surface increases perceptibly as said electrically conducting material is ruptured to remove the pills.

20. A system as in claim 19 wherein said housing is permanently attached to said foil pack container.

21. A system as in claim 19 wherein said electrically conducting material on the bottom of said foil pack container is indium tin oxide, polyppyrrole, polythiophene, polyaniline, polyacetylene, $PbO_2$, SnO or ZnO.

* * * * *